US006439950B1

(12) United States Patent
Goldman et al.

(10) Patent No.: US 6,439,950 B1
(45) Date of Patent: Aug. 27, 2002

(54) INFLATABLE TOY

(75) Inventors: Michael J. Goldman, Marlton, NJ (US); Leonard R. Clark, Jr., Oreland, PA (US); Colin Merlo, Haddonfield; Christopher F. Lauria, Cherry Hill, both of NJ (US)

(73) Assignee: Goldman Toy Group, Inc., Cherry Hill, NJ (US)

( * ) Notice: Subject to any disclaimer, the term of this patent is extended or adjusted under 35 U.S.C. 154(b) by 0 days.

(21) Appl. No.: 09/608,141

(22) Filed: Jun. 30, 2000

(51) Int. Cl.[7] ..... A63H 3/06
(52) U.S. Cl. ..... 446/220; 446/221; 446/224
(58) Field of Search ..... 446/220, 221, 446/222, 223, 224, 225, 226, 186, 187; 137/223

(56) References Cited

U.S. PATENT DOCUMENTS

| | | | | | |
|---|---|---|---|---|---|
| 602,294 | A | | 4/1898 | Arnold | |
| 743,570 | A | | 11/1903 | Savage | |
| 1,098,303 | A | * | 5/1914 | Steiner et al. | 446/220 |
| 1,461,193 | A | | 7/1923 | Larsen | |
| 1,464,107 | A | | 8/1923 | Pedersen | |
| 2,101,646 | A | | 12/1937 | Gordon, Jr. | |
| 2,592,347 | A | * | 4/1952 | Shute | 446/220 |
| 2,698,028 | A | | 12/1954 | Lee et al. | |
| 2,908,109 | A | | 10/1959 | Rotwein | |
| 3,020,673 | A | | 2/1962 | Cooke | |
| 3,645,651 | A | | 2/1972 | Bills | |
| 4,149,338 | A | * | 4/1979 | Wolf | 446/220 |
| 4,758,198 | A | * | 7/1988 | Ishiwa | 446/220 |
| 4,828,526 | A | | 5/1989 | Schneider et al. | |
| 4,991,617 | A | * | 2/1991 | Butler | 137/223 |
| 5,098,095 | A | | 3/1992 | Weiss | |
| 5,162,013 | A | | 11/1992 | von Mohr | |
| 5,238,244 | A | | 8/1993 | Cotter et al. | |
| 5,261,850 | A | * | 11/1993 | Barthold | 446/180 |
| 5,496,203 | A | * | 3/1996 | Murray | 446/222 |
| 6,093,077 | A | * | 7/2000 | Spector | 446/226 |
| 6,164,314 | A | * | 12/2000 | Seputo et al. | 137/232 |

FOREIGN PATENT DOCUMENTS

| | | | | |
|---|---|---|---|---|
| GB | 2226960 A | * | 1/1989 | 446/225 |

* cited by examiner

*Primary Examiner*—Jacob K. Ackun
*Assistant Examiner*—Faye Francis
(74) *Attorney, Agent, or Firm*—Michael de Angeli

(57) ABSTRACT

An inflatable toy comprises a simple and durable pump, comprising a bladder or other hand-operated source of air pressure, which inflates a balloon, typically shrouded in an expansible fabric, decorated with a character or the like, so that the character is distorted in an amusing manner when inflated. A first check valve allows air to pass from the bladder to the balloon when the bladder is squeezed, while a second check valve allows the bladder to refill itself while preventing air from being released from the balloon when hand pressure on the bladder is relaxed. A user-operated deflation valve allows pressure to be controllably released from the balloon. In one embodiment, the user-operated deflation valve is located such that the inflation bladder can be squeezed and the deflation valve operated without changing the position of the toy in one's hand, further increasing the user's enjoyment of the toy.

9 Claims, 4 Drawing Sheets

8
8a
8b
8c
8d
8e
8f
8g
VALVES
7
7a
7b
7c
7d
7e
2
3
5
5a
15
15a
15b
16
16a
16b
16c
16e
17
18
18a
19
19a
19b
19c
20
20a
20b
21
22
23
24

INFLATABLE TOY

FIELD OF THE INVENTION

This invention relates to a three-dimensional toy, typically designed to resemble a character, animal, vehicle, or the like, comprising at least a first portion, typically the head of the character, that can be inflated by squeezing a second portion, typically the body, and which can be controllably deflated.

BACKGROUND OF THE INVENTION

The prior art includes several patents disclosing inflatable toys. For example, Cooke U.S. Pat. No. 3,020,673 shows a doll comprising a hollow rubber figurine, which is inflated as it is manipulated. The Cooke doll comprises one or more bellows-like devices including check valves, so that when the bellows is squeezed and released, air is forced into the interior of the doll, expanding it without distorting its overall shape; see col. 1, lines 28–30.

Savage U.S. Pat. No. 743,570 shows an inflatable snake or the like that is provided with a valve for inflation and "slow leakage" (p. 1, line 40), so that the toy assumes various shapes during inflation and deflation.

Larsen U.S. Pat. No. 1,461,193 shows a toy having two bladders interconnected at a central neck having oppositely-disposed check valves formed therein. Both bladders are simultaneously inflated through a separate orifice. Play consists of forcing air back and forth between the bladders, making a whistling sound. Pedersen U.S. Pat. No. 1,464,107 shows a generally similar toy.

Also of some relevance to the present invention are Gordon U.S. Pat. No. 2,101,646, showing an inflatable floating water toy, arranged such that exhausting air propels the toy; Schneider U.S. Pat. No. 4,828,526, showing a toy comprising a squeezable portion containing a bladder, and an animation mechanism driven by the compressed air thus produced; Cotter U.S. Pat. No. 5,238,244 and Arnold U.S. Pat. No. 602,294, showing self-inflating balls; Lee U.S. Pat. No. 2,698,028 showing a valve for inflatable articles; von Mohr U.S. Pat. No. 5,162,013, showing a toy that snaps between different configurations; and Rotwein U.S. Pat. No. 2,908,109 and Bills U.S. Pat. No. 3,645,651, both showing pumps comprising check valves formed by flaps of resilient material.

OBJECTS AND SUMMARY OF THE INVENTION

None of the above references show an inflatable toy, wherein a squeezable bladder, bellows or other hand-operated pump inflates an expanding balloon or like member so as to create an amusing change of the appearance of the toy. More particularly, none of these references show an inflatable toy wherein the appearance of the toy is distorted in an amusing manner upon inflation, for example by variation in the proportion of its components. Moreover, none of these references show an inflatable toy wherein the expanding balloon can be deflated controllably, so as to allow the user complete control over the degree of inflation. To provide such a toy, and in particular such a toy which is inexpensively manufacturable and durable in use, is the principal object of the invention.

A more particular object of one embodiment of the invention is to provide such a toy that can be operated—that is, repetitively inflated and deflated—while holding the toy in one hand; this allows a user to play with the toy while using the other hand for other purposes, e.g., while talking on the telephone. The toy thus has much broader appeal than if two hands are required to manipulate it.

According to the present invention, an inflatable toy comprises a simple and inexpensively manufacturable pump, configured such that as a bladder or the like is squeezed, air is pumped into an inflatable balloon. In one preferred embodiment, the balloon is shrouded by an expandable fabric material, such as "Spandex", on which may be printed a design, such as the face or head of a character or the like. The bladder may conveniently be disposed inside the body portion of the character, so that as the body is squeezed, the head inflates; the change in their relative proportion distorts the character's appearance, providing a source of amusement. Appendages such as ears or eyes may also be provided, and may themselves be distorted as the balloon is inflated. The covering shroud may include "hidden reveals", that is, lettering or additional figuring that is only seen as the toy expands. A user-operable release valve is provided, so that the user can repetitively inflate and deflate the balloon; in one embodiment, both can be accomplished with one hand. The pressure thus released can be employed to sound a whistle or provide another audible effect, or to power an animated portion of the toy, e.g. to spin a toy airplane's propellor. A pressure-relief valve is also provided, to prevent overpressurization of the balloon.

BRIEF DESCRIPTION OF THE DRAWINGS

The invention will be better understood if reference is made to the accompanying drawings, in which.

DESCRIPTION OF THE PREFERRED EMBODIMENT

Figure 1A:
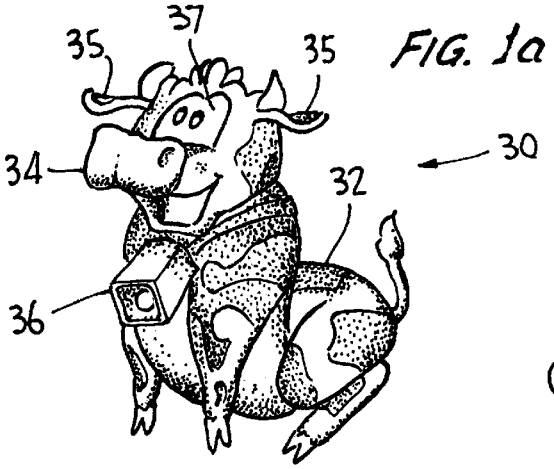
FIG. 1, comprising FIGS. 1(*a*)–(*c*), shows several perspective views of one embodiment of the toy of the invention, illustrating the inflation of the head portion of the toy.
Figure 1B:
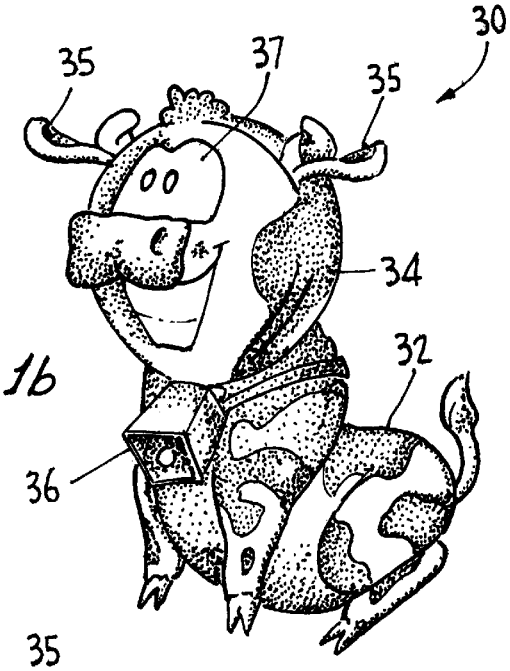
Figure 1C:
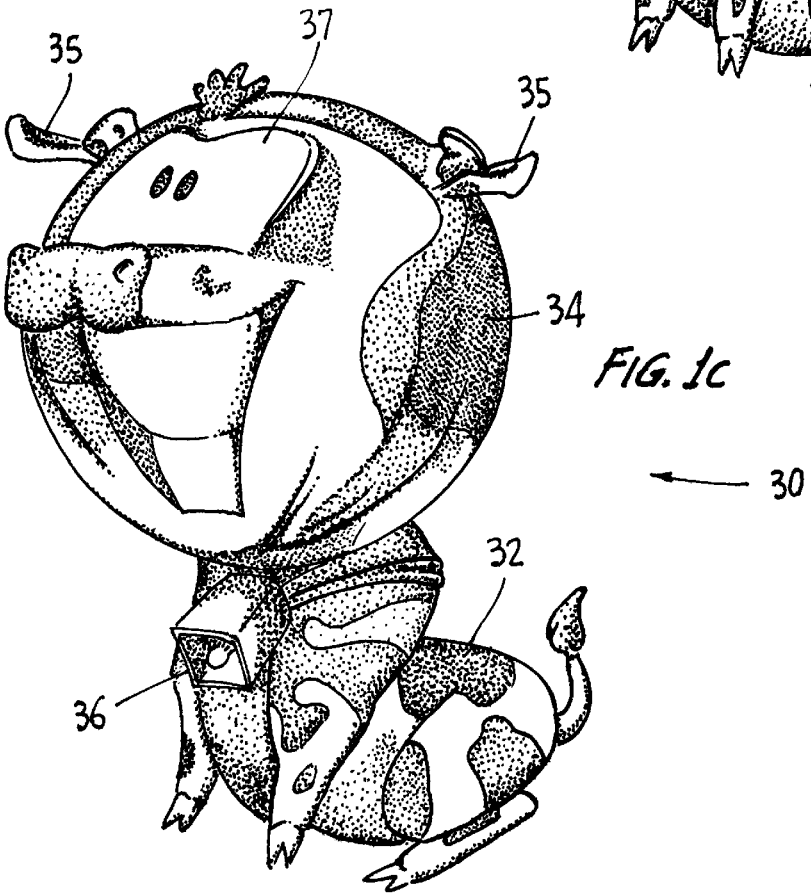

As indicated, FIG. 1 comprises FIGS. 1(*a*)–(*c*), showing the toy of the invention 30 in an embodiment resembling a stylized cow. In this embodiment, the toy 30 comprises a pump actuated by squeezing a body portion 32, which inflates a head portion 34, illustrated at several stages of inflation in FIGS. 1(*a*)–(*c*). The toy comprises a valve for controllably deflating the head; in this embodiment, the valve is actuated by a control member 36 resembling a cowbell. In one embodiment, the toy is sized so that the body portion can be readily squeezed in one hand, and the control member 36 may be located so that it can be conveniently operated with the same hand.

Figure 2:
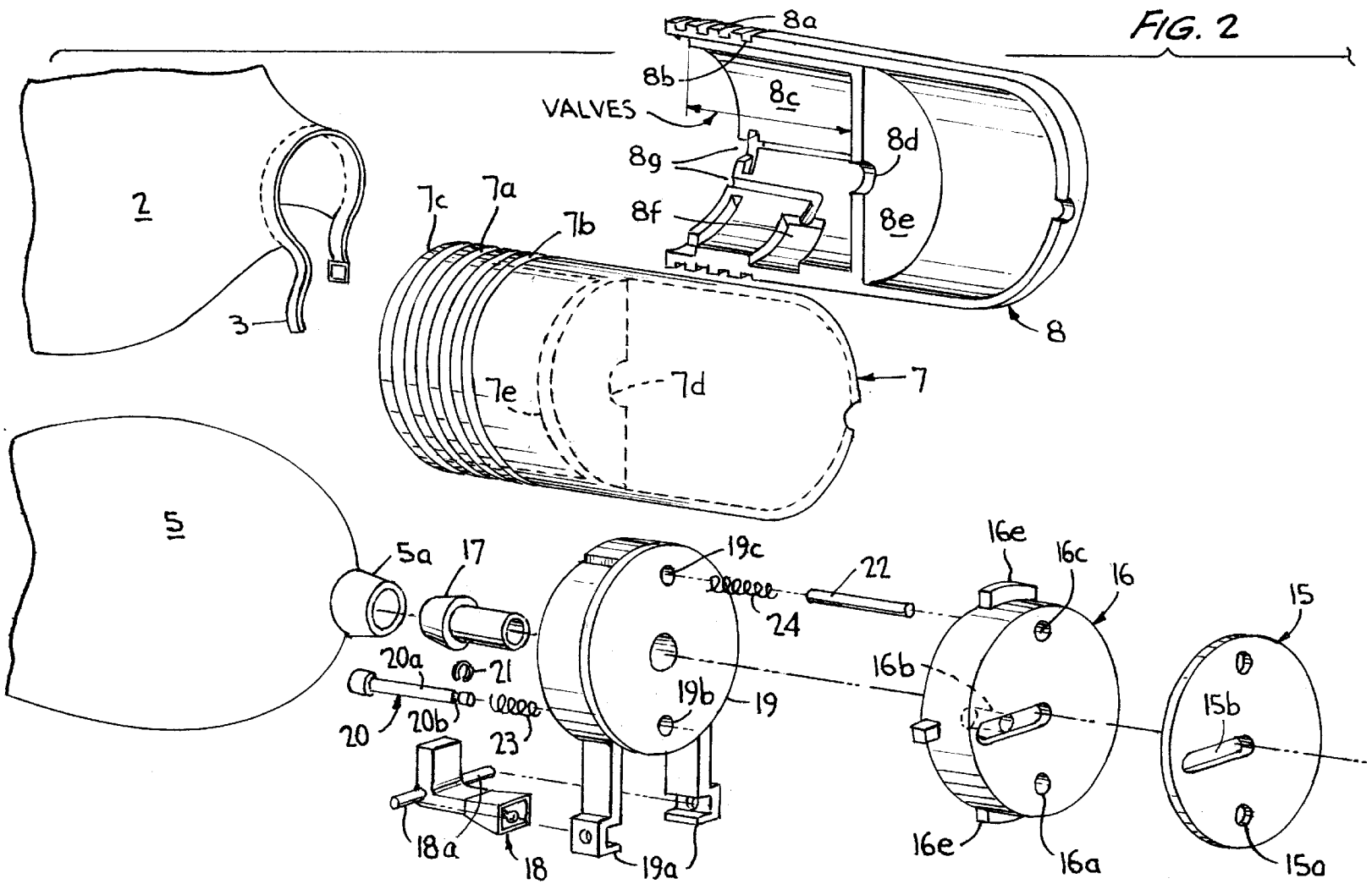
FIG. 2 is an exploded perspective view of one embodiment of the principal mechanical components of the toy.
Figure 2:
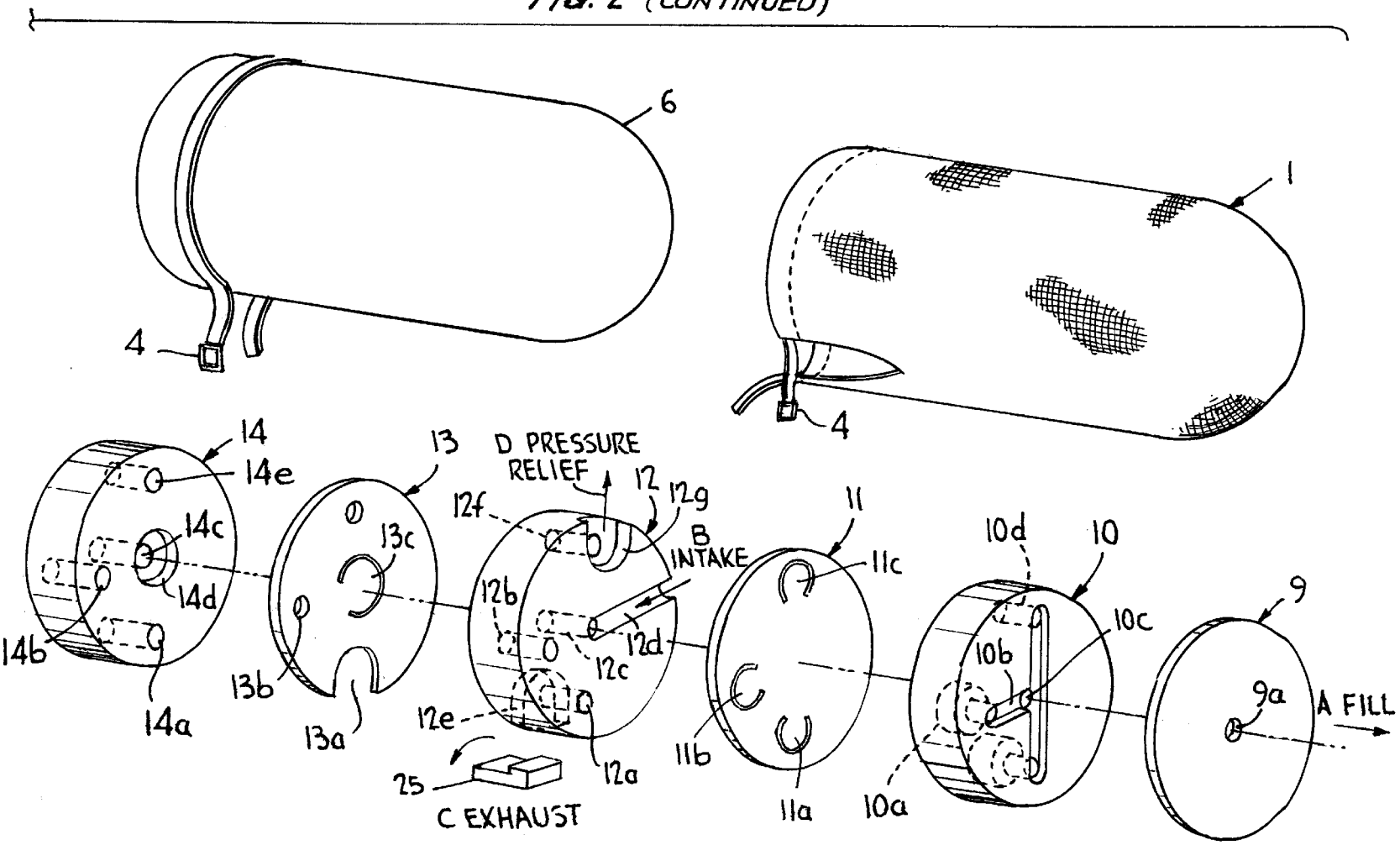
Figure 3A:
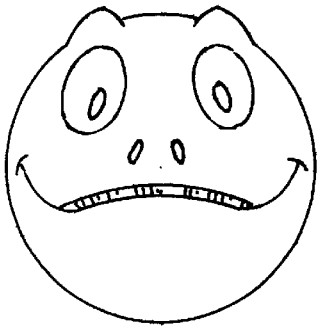
FIGS. 3, comprising FIGS. 3(*a*) and (*b*), illustrates "hidden reveals", that is, printed features that are only visible when the toy is inflated.
Figure 3B:
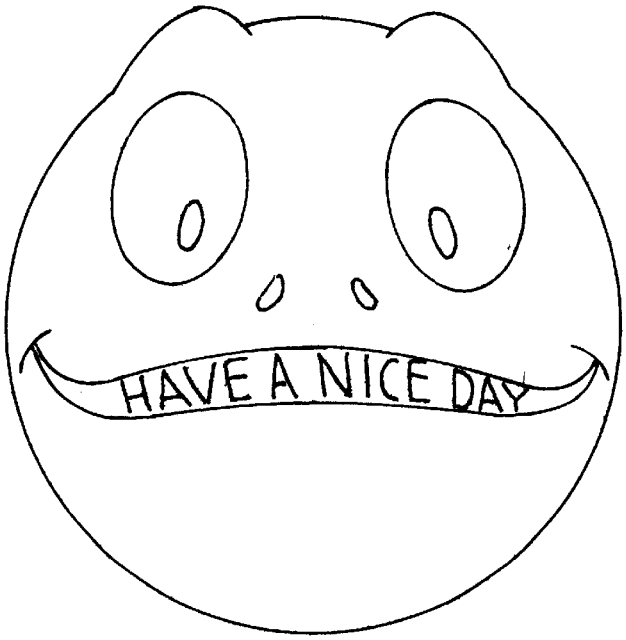

FIG. 2 shows an exploded view of the principal components of the toy in an embodiment suitable for the stylized cow implementation shown in FIG. 1. The head 34 comprises two mating molded members 7 and 8. Members 7 and 8 receive pump components discussed below, and are bonded to one another to complete the assembly. An airtight balloon 6 and an expandable cover member 1 are then secured over the assembly. As indicated above, cover member 1 may comprise an expandable "Spandex" fabric member having a character face or the like printed thereon, while balloon 6 is a latex diaphragm. Cover member 1 and balloon 6 are sealed to the paired members 7 and 8 by tie members 4, fitting into grooves 7*a*, 7*b*, 8*a*, 8*b*, as shown. Thus, as balloon 6 is inflated, cover member 1 is expanded, altering its appearance in any of a variety of ways. As noted, cover member 1 may be printed to define "hidden reveals", i.e., messages or other features that are unseen or not readable until the cover is substantially fully expanded. See FIGS. 3(*a*) and (*b*).

As indicated at 7*c*, 8*c*, depicting mating recesses in members 7 and 8, paired members 7 and 8 are molded to cooperatively define a generally cylindrical internal cavity, into which are assembled the pump and valve components necessary to provide the desired functions mentioned; that is, the pump and valve components (discussed in detail below) are generally circular members that are stacked, disposed in the mating recesses 7*c*, 8*c*, and then permanently retained in the proper relation by fixing paired members 7 and 8 with respect to one another.

The body portion 32 of the toy comprises a bladder 5, which may be roto-molded of polyvinylchloride plastic, blow-molded of polypropylene or "Kraton" materials, or formed in other known methods; for example, bladder 5 may be made of foam rubber surrounded on either side by vinyl sheet material, and formed to define a single outlet. This material and the others mentioned can thus be used to form a durable member which can be squeezed to expel air and which will then expand to its original shape, as in the manner of a syringe bulb. Other types of hand-operated pumps may be preferable in adapting the invention to toys emulating other types of object; for example, certain objects may lend themselves to emulation using bellows-type or piston pumps.

In the embodiment shown, bladder 5 is enclosed within a fabric body cover 2 (partially shown in FIG. 2), which may be made of a "plush" or similar fabric and secured over bladder 5 and body components 7 and 8 with a further plastic tie 3 or the equivalent.

The principal pump components are three plastic disc members, 10, 12 and 14, each being a very simple part having only through-holes formed therein, or counterbores or reliefs formed in the opposed faces thereof, so as to be moldable using extremely simple, low cost tooling, a slightly more complicated disc member 16, four gasket/valve members 9, 11, 13, and 15, each comprising a plain sheet of suitable rubber or like flexible resilient material, and punched to define valve flapper members and through holes, and an end manifold member 19, which is molded of plastic. A user-operated deflation valve, that is, a pressure release mechanism, comprises a trigger member 18 and an actuator 20, as well as a return spring 23 and a C-clip 21. Preferably, a pressure relief valve is provided by a second actuator 22 and a second spring 24.

In assembly of the pump and valve components, the end manifold member 19 is bonded (or otherwise fixed) to disc member 16, and this assembly is stacked together with gasket/valve member 15, disc member 14, gasket/valve member 13, disc member 12, gasket/valve member 11, disc member 10, and gasket/valve member 9, as shown. These components are then disposed in the opposed cavities 7*c*, 8*c*, and are confined therein by members 7 and 8 being fixed to one another. In order to ensure proper alignment, these components may be keyed or otherwise not perfectly circular in outline, as indicated at 16*e*, and fit into correspondingly-shaped portions of cavities 7*c*, 8*c*.

As indicated, trigger member 18 comprises two opposed arms 18*a*. The ends of arms 18*a* snap into opposed retainer arms 19*a* formed integrally on manifold 19, so that trigger member 18 can be pivoted with respect to manifold 19. Actuator 20 is inserted through a bore 19*b* in manifold 19, a further bore 16*a* in disc member 16, a hole 15*a* in valve/gasket member 15, a further bore 14*a* in disc member 14, a cutout 13*a* in gasket/valve member 13, and a bore 12*a* in disc member 12. The tip of actuator 20 thus abuts a valve flap 11*a* in gasket/valve member 11, which is held normally closed by air pressure within balloon 6 (as discussed further below). As actuator 20 is inserted, return spring 23 is disposed over the shank 20*a* thereof, between trigger 18 and manifold 19, biasing trigger 18 away from manifold 19; actuator 20 is retained by C-clip 21, fitting into groove 20*b*, and confined between discs 12 and 14, in cutout 13*a* and a mating recess in disc 12, as shown.

The mouth 5*a* of bladder 5 fits over and is secured to a nipple 17 formed integrally with or sealed to manifold 19, so that as bladder 5 is squeezed, air is forced into manifold 19. Air then passes through a bore 16*b* in disc 16, a mating slot 15*b* punched in gasket/valve 15, a bore 14*b* in disc 14, a mating hole 13*b* punched in gasket/valve 13, and a bore 12*b* in disc 12, so that air pressure is exerted on a flapper valve 11*b* formed in gasket/valve member 11; flapper valve 11*b* then opens, moving rightwardly in FIG. 2, into a counterbore or relief 10*a* in disc 10. The pressurized air then passes along a channel 10*b* formed in the face of disc 10 abutting gasket/valve 11, passes through a through-hole 10*c* in disc 10, and through mating holes 9*a* in gasket 9 and a passage formed by mating notches 7*d*, 8*d* in a partition formed by mating members 7*e*, 8*e* formed in body halves 7 and 8, filling the interior volume of balloon 6, as indicated by arrow A.

When the user releases hand pressure on bladder 5, it begins to expand, so that the pressure in it, and in the passage connecting its interior to the interior of balloon 6, becomes negative with respect to the pressure in balloon 6. Consequently, the positive pressure in balloon 6 closes flapper valve 11*b*, sealing it around bore 12*b*, the valve surface being significantly larger than the diameter of bore 12*b* to ensure a good seal, preventing escape of air from the interior of balloon 6. That is, the surface of member 12 thus forms a flat seat for flapper valve 11*b*. At the same time, the negative pressure in bladder 5 opens a second flapper valve 13*c*, which is disposed so as to normally close a passage 12*c* formed in disc 12 connecting a bore 12*d* therein to the ambient atmosphere. More specifically, the negative relative pressure in bladder 5 is communicated to second flapper valve 13*c* by way of manifold 19, bore 16*b*, hole 15*b*, and a bore 14*c* formed in disc 14, which also defines a counterbore or relief 14*d* into which flapper valve 13*c* can open.

Thus, when the user exerts hand pressure on bladder 5, air flows through flapper valve 11*a*, inflating balloon 6. Flapper valve 11*a* thus forms a first check valve. When the user releases hand pressure, bladder 5 expands, and the negative pressure therein (i.e., with respect to the pressure in balloon 6) closes flapper valve 11*a*, preventing escape of air from balloon 6, while refilling bladder 5 via air intake passage 12*c* (as indicated by arrow B) and flapper valve 13*c*, which thus forms a second check valve. A simple and sturdy inflation pump is thus provided.

As noted above, it is an object of the invention to provide a simple release mechanism whereby pressure in the balloon can be conveniently released by the user, to increase the entertainment value of the toy. In the embodiment shown, pressure in balloon 6 is released by operating trigger mechanism 18, which causes plunger 20 to open flapper valve 11*a*, which thereby also functions as a user-operated deflation valve. More specifically, as mentioned above, air pressure in balloon 6 is exerted on flapper valve 11*a* via passage 10*d,* urging flapper 11*a* closed against disc 12. When the user desires to release the pressure in balloon 6, he or she presses the "cowbell" (in this embodiment) of trigger assembly 18, urging actuator 20 rightwardly against the bias of spring 23. The tip of actuator 20 then forces flapper 11*a* away from the surface of disc 12, allowing air to pass from balloon 6 along passage 10*d,* into bore 12*a,* and to the ambient atmosphere via vent 12*e,* as indicated by arrow C. A "squeaker" 25 including a vibrating reed or like noisemaker may be inserted in recess 8*f,* and retained against vent 12*e,* so as to emit a controlled or predesigned sound when the pressure is thus released.

Figure 4A:
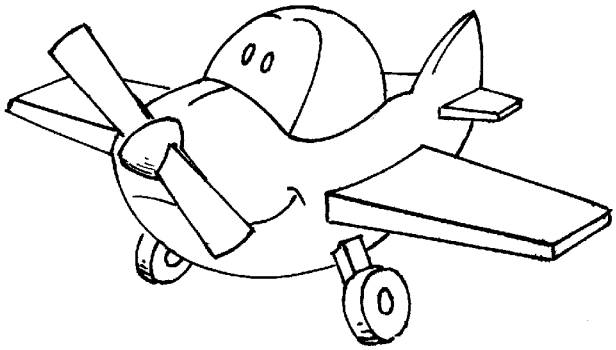
FIG. 4, comprising FIGS. 4(*a*)–(*c*), illustrates an alternative embodiment of the invention where released air pressure operates an animated component of the toy.
Figure 4B:
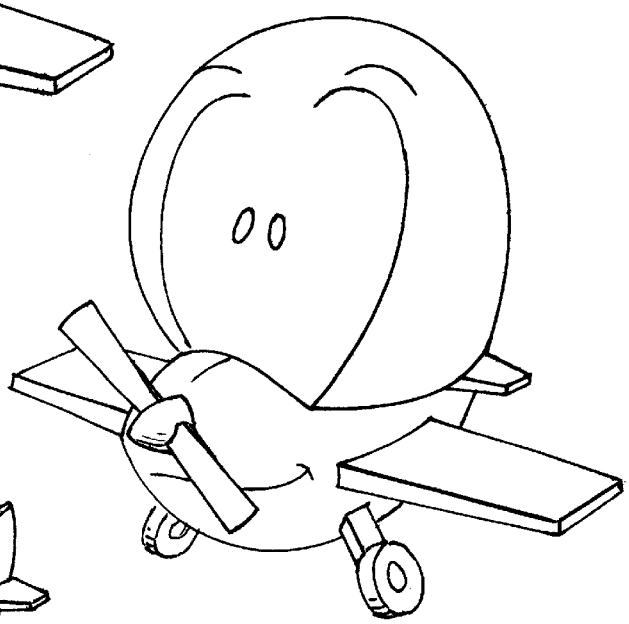
Figure 4C:
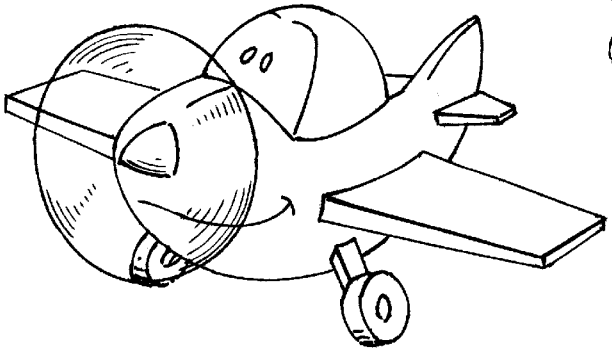

Alternatively, the released pressure can be used to power an animated portion of the toy, e.g., to rotate an airplane's propeller, generally as disclosed in the Schneider patent discussed above, or the like. See FIGS. 4(*a*)–(*c*); FIG. 4(*a*) shows a toy airplane according to the invention, in its deflated condition; FIG. 4(*b*) shows its cockpit inflated, i.e., the cockpit portion of the toy contains the balloon; and FIG. 4(*c*) shows the propellor spinning upon release of the air stored in the balloon.

It is desirable to provide a pressure relief valve, so that the user is prevented from overfilling and rupturing balloon 6. In the embodiment shown, a relief valve is provided by a second actuator 22, which slides in bores 19*c* in manifold 19, 16*c* in disc 16, 14*e* in disc 14, and 12*f* in disc 12, and through mating holes in the intermediate gasket/valve members. Actuator 22 is biased rightwardly in FIG. 2 by a spring 24 retained in bore 19*c*, so that its head urges a further flapper valve 11*c* in gasket/valve 11 closed against the surface of disc 10, around a bore 10*d* formed therein and in communication with the interior of balloon 6 via bore 10*c*. Thus, when the pressure in balloon 6 is sufficient to open valve 11*c* against the bias of spring 24, air reaches the ambient atmosphere via vent passage 12*g*, as indicated by arrow D. Vent passage 12*g*, as well as the other vents and intake ports mentioned, may communicate with the ambient by passages formed in the inner walls of body portions 7 and 8, as indicated at 8*g*.

It will thus be appreciated that the toy of the invention comprises a simple and durable pump, comprising a bladder or other hand-operated source of air pressure; an inflatable balloon; a first check valve, allowing air to pass from the bladder to the balloon when the bladder is squeezed, such that the pressure is greater in the bladder than the balloon; a second check valve, allowing the bladder to refill itself while preventing air from being released from the balloon, when hand pressure on the bladder is relaxed; and a user-operated deflation valve, allowing pressure to be released from the balloon. Preferably, a spring-loaded relief valve is also provided, preventing overpressurization of the balloon. In one embodiment, the user-operated deflation valve is located such that the inflation bladder can be squeezed and the deflation valve operated without changing the position of the toy in one's hand, further increasing the user's enjoyment of the toy.

While the invention has been illustrated in a preferred embodiment, it will be apparent that there are many modifications and improvements thereto that are within its scope. For example, the replacement of the bladder as the source of pressurized air with a bellows or piston-type pump has already been mentioned. The simple flapper-type check valves shown in the preferred embodiment of FIG. 2 could be replaced with other known types of check valves, e.g., "duckbill" or spring-biased valves. Similarly, while the toy has been shown as resembling an animal or vehicle, the same basic mechanism could be used, and the objects of the invention, realized in other forms. For example, the toy could be configured as a human figure; the body of such a figure could contain the squeezable bladder and the head expand. Plural balloons and shrouds could also be provided to increase the caricaturish effect of the expansion of the inflatable portion of the toy. For example, a toy according to the invention and made to suggest a human figure might have limbs that expand along with the head. Numerous other alternatives for providing an amusing change of shape as the toy is distorted upon inflation will occur to those of skill in the art; for example, the ears 35 of the stylized cow of FIG. 1 could be made to stand up when inflated, or the eyes 37 could be made to expand disporportionally rapidly compared to the rest of the head. As mentioned, the shrouding cover 1 over the balloon, which expands when the balloon is inflated, could be printed with a variety of amusing designs, including "hidden reveals", that is, messages, additional features, or the like, which are only visible when the shrouding cover 1 is expanded. Compare FIGS. 3*a* and 3*b*. The toy could also be configured as an airplane, locomotive, truck, car, or the like. Various animated features driven by air pressure released by the control provided according to the invention will occur to those of skill in the art, as exemplified in FIG. 4.

Therefore, it will be appreciated that the invention is not to be limited to the preferred embodiment shown, but is to be limited only by the appended claims.

What is claimed is:

1. An inflatable toy, comprising a hand-powered source of air pressure, an inflatable balloon shrouded in an expandible decorative member, a pump comprising first and second check valves connecting said source of air pressure and said balloon, whereby said balloon can be inflated by a user applying hand pressure to said source of air pressure, and a hand-operated deflation valve for controllably releasing pressure from said balloon, wherein:

said first and second check valves and said deflation valve each comprise a flapper valve member, defined by cutting a flat sheet of resilient material to define the outline of said flapper valve member, said flat sheet of resilient material being confined between opposed flat discs, such that a first side of said flapper valve member is juxtaposed to a port formed in one of said discs and a second side thereof is juxtaposed to a relief formed in the other of said discs, said port being smaller in diameter than said flapper valve member, such that the surface of said disc surrounding said port forms a flat seat member on one side of said flapper member against which said flapper valve member is urged in the closed position, wherein when the pressure on the relief side of said flapper valve of said first and second check valves exceeds the pressure in the corresponding port, said flapper member is urged against said seat, closing said port, and when the pressure on the relief side of said flapper valve member is less than the pressure in said port, said flapper valve member moves away from said normally closed position into said relief, opening said port; and wherein said flapper valve member of said user operated deflation valve is urged against the corresponding seat by pressure within said balloon, and said deflation valve comprises a user-operated actuator for moving said flapper valve member away from said seat, releasing pressure within said balloon.

2. The toy of claim 1, further comprising a pressure relief valve for preventing overpressurization of said balloon, said relief valve comprising a further flapper valve member spring-biased against a further seat to retain pressure in said balloon.

3. The toy of claim 1, wherein said balloon is shrouded by an expandable fabric member, such that said fabric member expands as said balloon is inflated by operation of said hand-powered source of air pressure.

4. The toy of claim 3, wherein said expandable fabric member is decorated with printed material such that additional features thereof become visible as said member expands upon inflation of said balloon.

5. The toy of claim 1, wherein said hand-powered source of air pressure comprises a bladder which expels air from its interior when squeezed and expands when released.

6. The toy of claim 1, wherein the port juxtaposed to said first side of said flapper valve member of said first check valve is connected to said hand-powered source of pressure, and the relief juxtaposed to the second side thereof is connected to the interior of said balloon, whereby said flapper valve member is normally held closed by the pressure of air within said balloon, but opens, allowing air to pass from the hand-powered source of air pressure into the balloon, when the hand-powered source of air pressure is operated by a user applying hand pressure to said source of air pressure.

7. The toy of claim 1, wherein the port juxtaposed to said first side of said flapper valve member of said second check valve is connected to the ambient atmosphere, and the relief juxtaposed to the second side thereof is connected to said hand-powered source of air pressure, such that the hand-powered source of air pressure draws atmospheric air into itself, while preventing air from being released from the balloon, when hand pressure on the hand-powered source of air pressure is relaxed.

8. The toy of claim 1, further comprising a noisemaking device in communication with said hand-operated deflation valve, such that an audible sound is produced when said valve is operated.

9. The toy of claim 1, further comprising an animated component device in communication with said hand-operated deflation valve, such that when said valve is operated, releasing air under pressure, said component is operated thereby.

* * * * *